US005884915A

United States Patent [19]

Koziol

[11] Patent Number: 5,884,915

[45] Date of Patent: Mar. 23, 1999

[54] GOLF GAME

[76] Inventor: James E. Koziol, 1513 Kenyon Dr., Naperville, Ill. 60565

[21] Appl. No.: 7,317

[22] Filed: Jan. 15, 1998

[51] Int. Cl.[6] ..... A63F 3/00; A63F 9/04

[52] U.S. Cl. ..... 273/245; 273/146

[58] Field of Search ..... 273/242, 243, 273/245, 277, 146

[56] References Cited

U.S. PATENT DOCUMENTS 1,513,941 11/1924 Smith ..... 273/245
1,638,365 8/1927 Ryan ..... 273/245
2,238,079 4/1941 Scheib ..... 273/245
3,826,498 7/1974 Monek ..... 273/245
3,944,229 3/1976 Fieney ..... 273/245
4,277,065 7/1981 White ..... 273/245
5,000,460 3/1991 Barbiaux et al. ..... 273/245
5,413,349 5/1995 Canther ..... 273/245

*Primary Examiner*—William E. Stoll

[57] ABSTRACT

A golf game apparatus is provided including a game sheet for tracking a score of a plurality of players at each of a plurality of holes of golf. Also included is a plurality of dice each representing a different set of numbers.

4 Claims, 2 Drawing Sheets

14 12

| OUT | 10 | 11 | 12 | 13 | 14 | 15 | 16 | 17 | 18 | IN | GROSS | HDCP | NET |
|---|---|---|---|---|---|---|---|---|---|---|---|---|---|
| 57 | 4 | 6 | 4 | 5 | 6 | 4 | 5 | 5 | 7 | 46 | 103 | | |
| 42 | ~~5~~ | 7 | 3 | 5 | ~~6~~ | 3 | 5 | 5 | 6 | 45 | 87 | 71 | |
| 43 | 5 | 6 | ~~3~~ | 6 | 5 | 3 | 5 | ~~5~~ | 5 | 43 | 86 | 74 | |
| 58 | 6 | ~~6~~ | ~~7~~ | 5 | ~~8~~ | 6 | 6 | 7 | ~~8~~ | 59 | 117 | 76 | |
| 54 | ~~4~~ | 8 | 5 | 5 | 7 | ~~6~~ | ~~5~~ | 6 | 7 | 54 | 107 | 76 | |
| 64 | 8 | ~~7~~ | 6 | 10 | ~~9~~ | 6 | 5 | 9 | ~~9~~ | 69 | 133 | 86 | |
| 49 | ~~4~~ | 4 | 3 | 5 | ~~6~~ | 4 | ~~6~~ | 5 | 10 | [illegible] | [illegible] | [illegible] | |
| 75 | 10 | [illegible] | | | | | | | | | | | |

GOLF GAME

BACKGROUND OF THE INVENTION

1. Field of the Invention

The present invention relates to games and more particularly pertains to a new golf game for providing a chance game to be played after a game of golf.

2. Description of the Prior Art

The use of games is known in the prior art. More specifically, games heretofore devised and utilized are known to consist basically of familiar, expected and obvious structural configurations, notwithstanding the myriad of designs encompassed by the crowded prior art which have been developed for the fulfillment of countless objectives and requirements.

Known prior art games include U.S. Pat. No. 3,944,229; U.S. Pat. No. 4,364,569; U.S. Pat. No. 5,449,174; U.S. Pat. No. 5,401,027; U.S. Pat. No. 3,937,475; and U.S. Pat. No. Des. 326,480.

In these respects, the golf game according to the present invention substantially departs from the conventional concepts and designs of the prior art, and in so doing provides an apparatus primarily developed for the purpose of providing a chance game to be played after a game of golf.

SUMMARY OF THE INVENTION

In view of the foregoing disadvantages inherent in the known types of games now present in the prior art, the present invention provides a new golf game construction wherein the same can be utilized for providing a chance game to be played after a game of golf.

The general purpose of the present invention, which will be described subsequently in greater detail, is to provide a new golf game apparatus and method which has many of the advantages of the games mentioned heretofore and many novel features that result in a new golf game which is not anticipated, rendered obvious, suggested, or even implied by any of the prior art games, either alone or in any combination thereof.

To attain this, the present invention generally comprises a game sheet having a rectangular configuration with a top face and a bottom face. As shown in FIG. 4, the top face has a plurality of columns each having a header and a plurality of rows. The columns, as identified by the headers thereof, include a player column, a plurality of columns representative of numerals 1–9, a plurality of columns representative of numerals 10–18, a gross score column, a handicap score column and a net score column. Situated between the columns representative of numerals 1–9 and the columns representative of numerals 10–18 is an out column. Next provided is a plurality of dice including a first die representing only numerals 1–3 and a second die representing only numerals 4–6. Associated therewith are a third die representing only numerals 7–9, a fourth die representing only numerals 10–12, a fifth die representing only numerals 13–15, and a sixth die representing only numerals 16–18. It should be noted that 2 sets of each number of the predetermined range are printed on each die.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf game apparatus and method which has many of the advantages of the games mentioned heretofore and many novel features that result in a new golf game which is not anticipated, rendered obvious, suggested, or even implied by any of the prior art games, either alone or in any combination thereof.

It is another object of the present invention to provide a new golf game which may be easily and efficiently manufactured and marketed.

It is a further object of the present invention to provide a new golf game which is of a durable and reliable construction.

An even further object of the present invention is to provide a new golf game which is susceptible of a low cost of manufacture with regard to both materials and labor, and which accordingly is then susceptible of low prices of sale to the consuming public, thereby making such golf game economically available to the buying public.

Still yet another object of the present invention is to provide a new golf game which provides in the apparatuses and methods of the prior art some of the advantages thereof, while simultaneously overcoming some of the disadvantages normally associated therewith.

Still another object of the present invention is to provide a new golf game for providing a chance game to be played after a game of golf.

Even still another object of the present invention is to provide a new golf game that includes a game sheet for tracking a score of a plurality of players at each of a plurality of holes of golf. Also included is a plurality of dice each representing a different set of numbers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
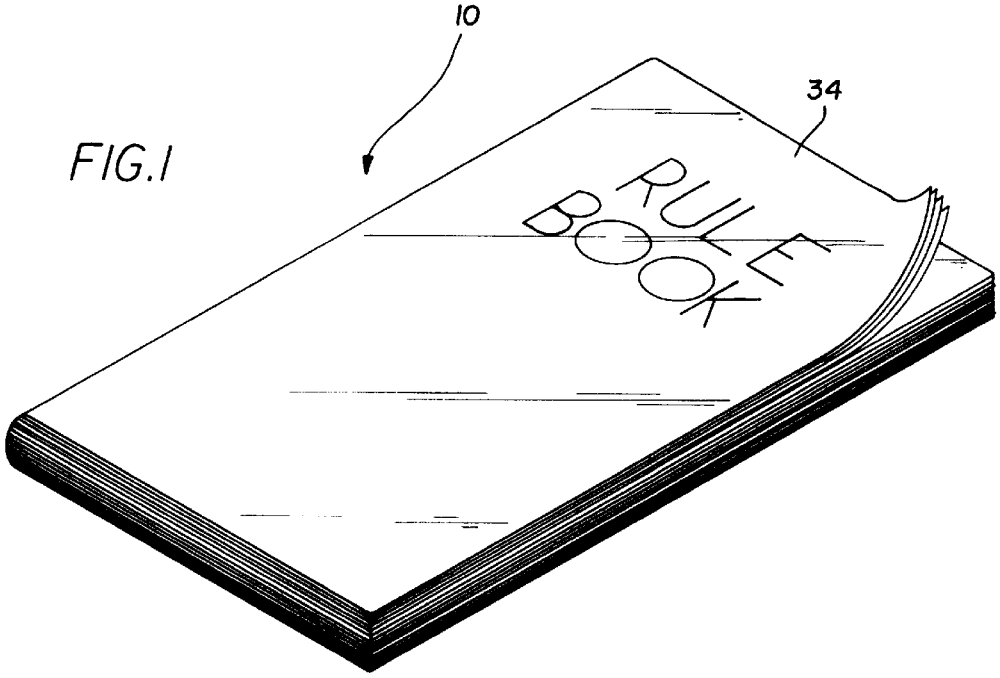
FIG. 1 is a perspective view of a rule book of a new golf game according to the present invention.
FIG. 2 is a perspective view of the game sheet of the present invention during use.
Figure 3:
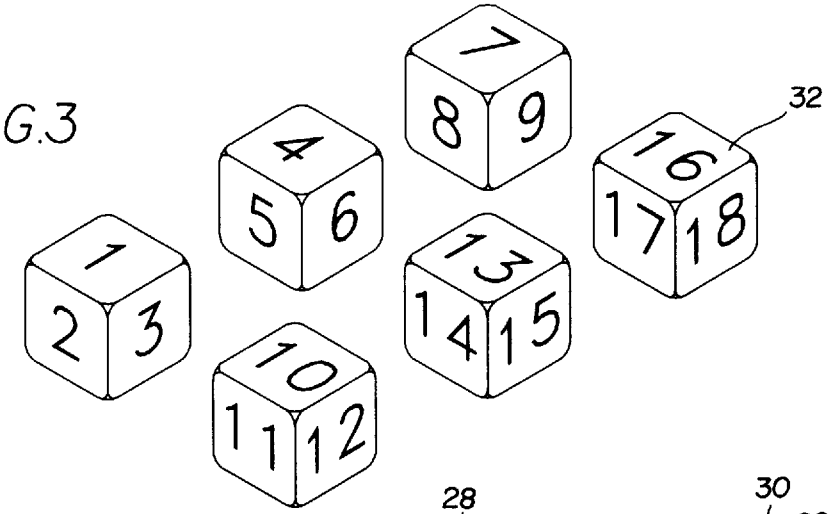
FIG. 3 is a perspective view of the various dice of the present invention.

With reference now to the drawings, and in particular to FIGS. 1 through 4 thereof, a new golf game embodying the principles and concepts of the present invention and generally designated by the reference numeral 10 will be described.

Figure 4:
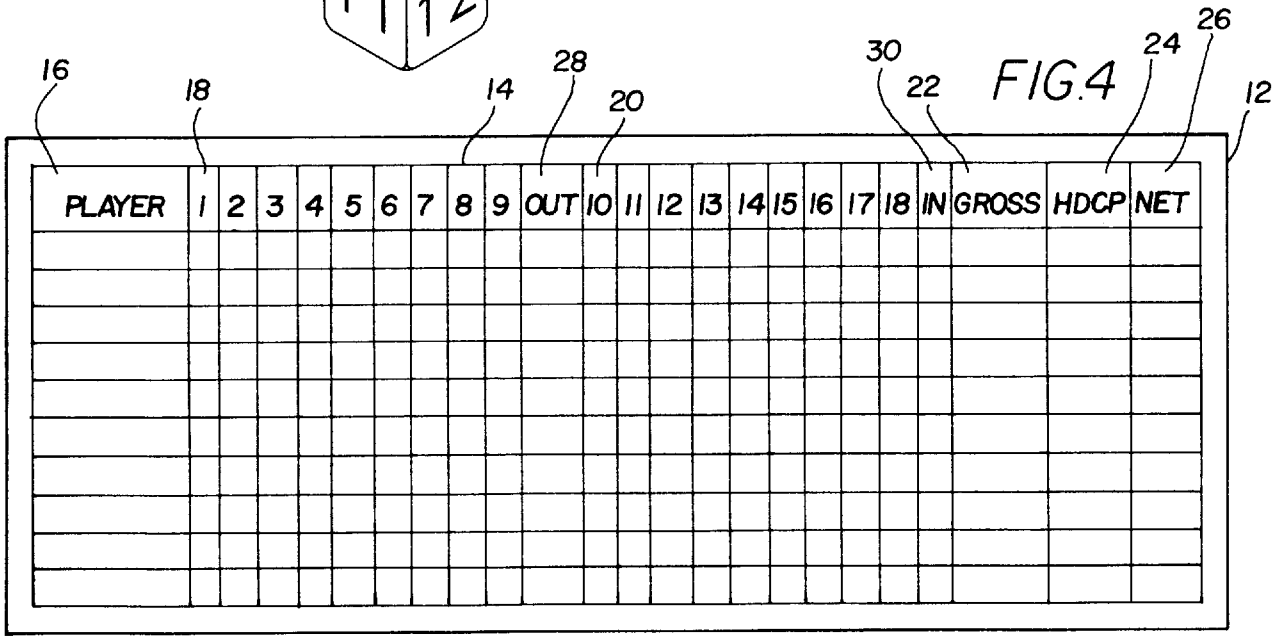
FIG. 4 is a perspective view of the game sheet of the present invention prior to use.

The present invention, designated as numeral 10, includes a game sheet 12 having a rectangular configuration with a top face and a bottom face. As shown in FIG. 4, the top face has a plurality of columns 14 each having a header and a plurality of rows. The columns, as identified by the headers thereof, include a player column 16 for listing each of the players participating in the game, a plurality of columns 18 representative of numerals 1–9 and a plurality of columns 20 representative of numerals 10–18 for tracking the score of each one of the holes of a game of golf, a gross score column 22 for recording the total of the holes immediately after play, a handicap score column 24 for recording another total score as will be set forth, and a net score column 26 for recording the difference between the totals. Situated between the columns representative of numerals 1–9 and the columns representative of numerals 10–18 is an out column 28. Associated therewith is an in column 30 situated adjacent the columns representative of numerals 10–18 and the gross column. The in and out columns are for recording subtotals. Note FIG. 2.

Next provided is a plurality of dice 32 including a first die representing only numerals 1–3 and a second die representing only numerals 4–6. Associated therewith are a third die representing only numerals 7–9, a fourth die representing only numerals 10–12, a fifth die representing only numerals 13–15, and a sixth die representing only numerals 16–18. It should be noted that 2 sets of each number of the predetermined range are printed on each die.

The method associated with the play of the present invention will now be set forth. Such method is preferably recorded in a rule book 34. The method first includes tracking a score of each of a plurality of players on the game sheet during a game of golf. Such scores include a separate score for each of a plurality of holes associated with the golf game. Thereafter, each player takes turn taking a certain number of dice from a bag. Such number of dice corresponds to a total score of the golf game.

Depending on the average score, one of two schemes is followed for determining how many dice are picked by each player.

Scoring scheme #1(for average scores of 90–95)(range of scores 75–115)

| Score | Number of Dice |
|---|---|
| 75–79 | 1 |
| 80–84 | 2 |
| 85–89 | 3 |
| 90–95 | 4 |
| 96–102 | 5 |
| above 102 | 6 |

Scoring scheme #2(for average scores of 105–111)(range of scores 90–130)

| Score | Number of Dice |
|---|---|
| 84–90 | 1 |
| 91–97 | 2 |
| 98–104 | 3 |
| 105–111 | 4 |
| 112–118 | 5 |
| above 118 | 6 |

Scoring scheme #3(for 9-hole golf game)

| Score | Number of Dice |
|---|---|
| 39–42 | 1 |
| 43–51 | 2 |
| above 51 | 3 |

Next, the dice are rolled during each of the player's turns. Once the dice are rolled, the score for certain holes of the golf game are deleted from the game sheet. It should be noted that the certain holes each correspond to a number represented by one of the dice. Note FIG. 2. After each of the turns, a new total is calculated for each player which does not include the deleted scores. A player with the lowest new total is a winner. In case of a tie, only the players that tied repeat the game to determine a winner in accordance with the foregoing rules.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf game apparatus comprising, in combination:

a game sheet having a rectangular configuration with a top face and a bottom face, the top face having a plurality of columns each having a header and a plurality of rows, the columns, as identified by the headers thereof, including a player column, a plurality of columns representative of numerals 1–9, an out column, a plurality of columns representative of numerals 10–18, a gross score column, a handicap score column and a net score column; and a plurality of dice including a first die representing only numerals 1–3, a second die representing only numerals 4–6, a third die representing only numerals 7–9, a fourth die representing only numerals 10–12, a fifth die representing only numerals 13–15, and a sixth die representing only numerals 16–18.

2. A method of playing a golf game comprising the steps of:

providing a game sheet for tracking a score of a plurality of players at each of a plurality of holes of golf;

providing a plurality of dice;

tracking a score of each of a plurality of players for each of a plurality of holes of golf;

rolling the dice;

deleting the score of holes of golf for each hole that corresponds to the dice in terms of a predetermined function; and adding a total not including the deleted scores for each player, wherein a player with the lowest total is a winner.

3. A method of playing a golf game as set forth in claim 2 and further including the step of randomly picking a number of dice corresponding to a total score of golf prior to rolling the dice.

4. A method of playing a golf game comprising the steps of:

providing a plurality of dice;

tracking a score of each of a plurality of players for each of a plurality of holes of golf;

rolling the dice;

deleting the score of holes of golf for each hole that corresponds to the rolled dice; and adding a total not including the deleted scores for each player, wherein a player with the lowest total is a winner.

* * * * *